US010009974B2

(12) United States Patent
Bremser et al.

(10) Patent No.: US 10,009,974 B2
(45) Date of Patent: Jun. 26, 2018

(54) DIM TO WARM LED LIGHTING SYSTEM

(71) Applicant: Tempo Industries, LLC, Irvine, CA (US)

(72) Inventors: Michael D. Bremser, Seal Beach, CA (US); Dennis Barton, Costa Mesa, CA (US)

(73) Assignee: Tempo Industries, LLC, Irvine, CA (US)

( * ) Notice: Subject to any disclaimer, the term of this patent is extended or adjusted under 35 U.S.C. 154(b) by 54 days.

(21) Appl. No.: 15/462,796

(22) Filed: Mar. 17, 2017

(65) Prior Publication Data

US 2017/0295620 A1 Oct. 12, 2017

Related U.S. Application Data

(60) Provisional application No. 62/320,515, filed on Apr. 9, 2016.

(51) Int. Cl.
*H05B 33/00* (2006.01)
*H05B 33/08* (2006.01)

(52) U.S. Cl.
CPC ..... *H05B 33/0845* (2013.01); *H05B 33/0809* (2013.01); *H05B 33/0857* (2013.01)

(58) Field of Classification Search
CPC ..... H05B 37/0272; H05B 41/2806; H05B 37/0227; H05B 37/0281; H05B 33/0854; H05B 33/0845; H05B 33/0872; H05B 41/3921; H05B 33/0803; H05B 33/0857; H05B 41/38; H05B 33/089; H05B 33/0809; H05B 37/00
See application file for complete search history.

(56) References Cited

U.S. PATENT DOCUMENTS

| | | | | |
|---|---|---|---|---|
| 8,860,326 | B2 | 10/2014 | Cahalane et al. | |
| 2013/0154488 | A1 | 6/2013 | Sadwick et al. | |
| 2017/0238401 | A1* | 8/2017 | Sadwick ..... | H05B 37/0281 315/294 |

* cited by examiner

*Primary Examiner* — Monica C King
(74) *Attorney, Agent, or Firm* — Lapple Ubell IP Law, LLP; Franklin D. Ubell

(57) ABSTRACT

First and second LED channels of different color temperatures are connected to respective first and second FET drivers. A wall dimmer output is connected to a driver circuit and to circuitry which generates a variable DC voltage. A microcontroller is configured to employ a signal derived from the driver circuit output to generate changing PWM signals which are supplied along with the variable DC voltage to each of the first and second FET drivers to create variable mixed light color and brightness.

17 Claims, 3 Drawing Sheets

DIM TO WARM LED LIGHTING SYSTEM

RELATED APPLICATION

This application claims the benefit of and priority to U.S. Provisional Patent Application Ser. No. 62/320,515, filed Apr. 9, 2016, entitled, "Dim to Warm LED Lighting System," the contents of which is incorporated by reference herein in its entirety.

FIELD OF THE DISCLOSURE

The subject disclosure relates to LED electric lighting systems, and more particularly to a system which may replicate the lighting characteristics of incandescent filament lamps.

DESCRIPTION OF RELATED ART

Various LED electric light fixtures have been constructed in the past, for example, such as those disclosed in U.S. Pat. Nos. 7,726,840 and 8,864,347, both assigned to Tempo Industries, LLC.

SUMMARY

In an illustrative embodiment, first and second LED channels of different color temperatures are connected to first and second FET drivers. A wall dimmer output is connected to a driver circuit and to circuitry which generates a variable DC voltage, and a microcontroller is configured to employ a signal derived from the output of the driver circuit and representative of a current dimmer setting to generate first and second pulse width modulated (PWM) signals. The first and second PWM signals are supplied respectively to each of the first and second FET drivers along with the variable DC voltage to create a variable mixed light color and brightness output.

DETAILED DESCRIPTION OF ILLUSTRATIVE EMBODIMENTS

Figure 1:
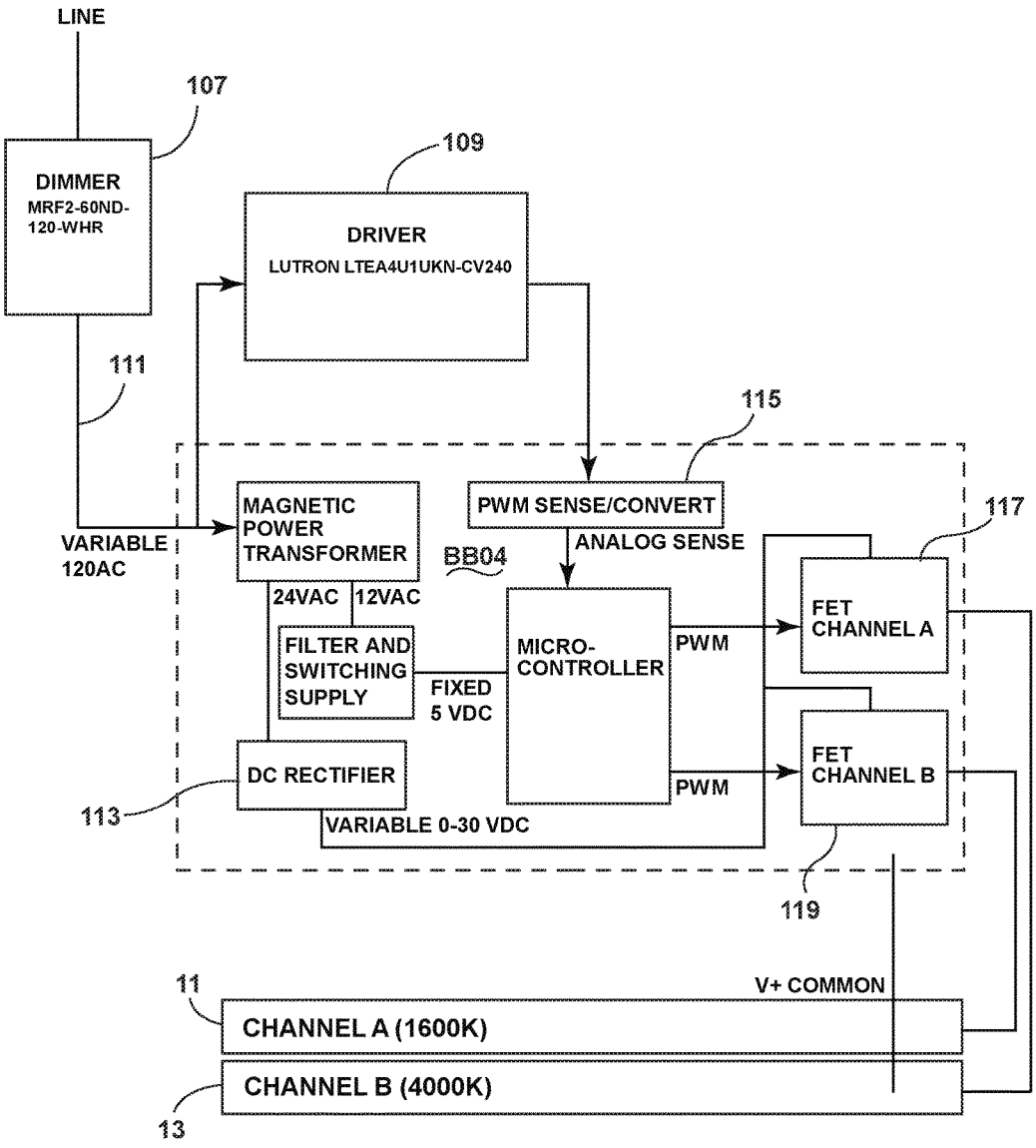
FIG. 1 is a schematic circuit block diagram of an LED light system according to an illustrative embodiment.
Figure 2:
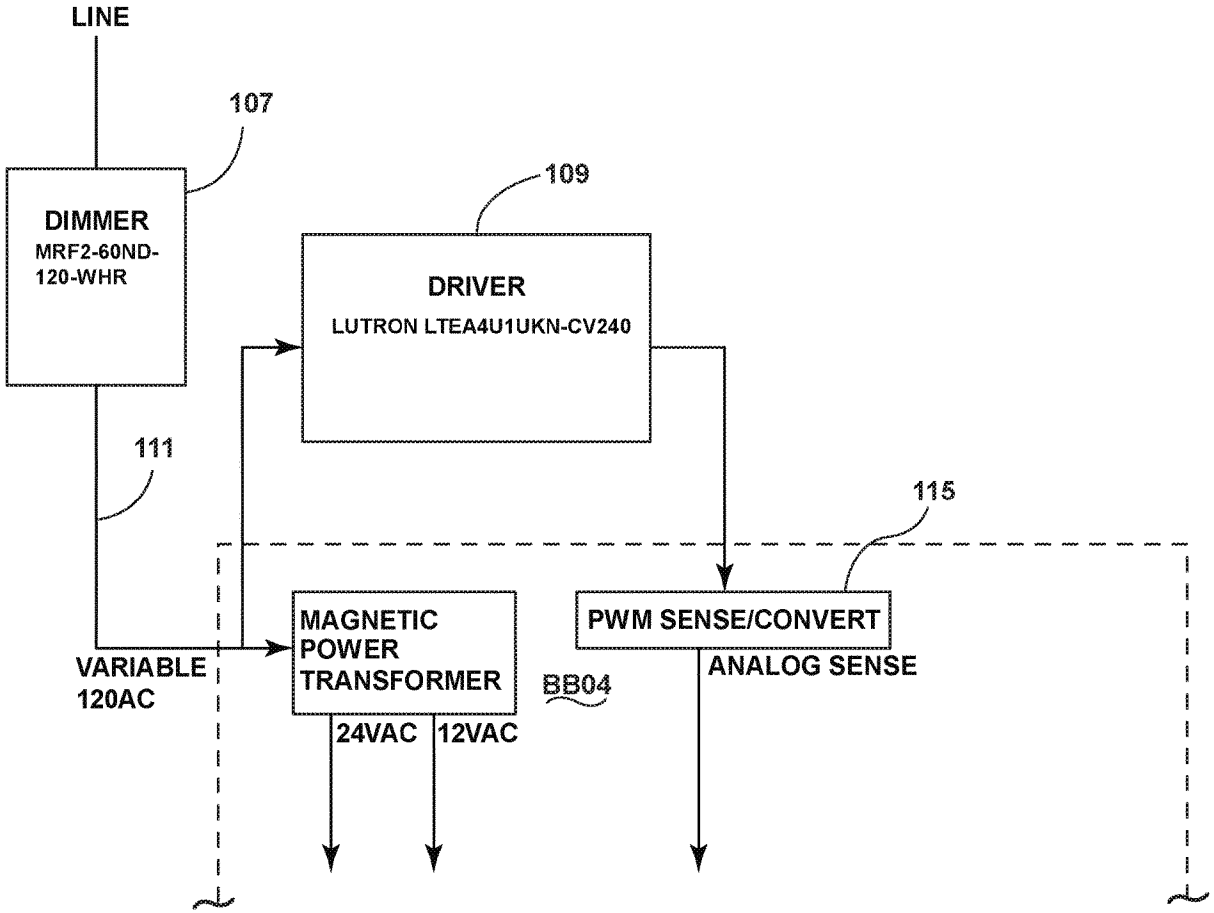
FIG. 2 is an enlarged view of a first portion of the block diagram of FIG. 1.
Figure 3:
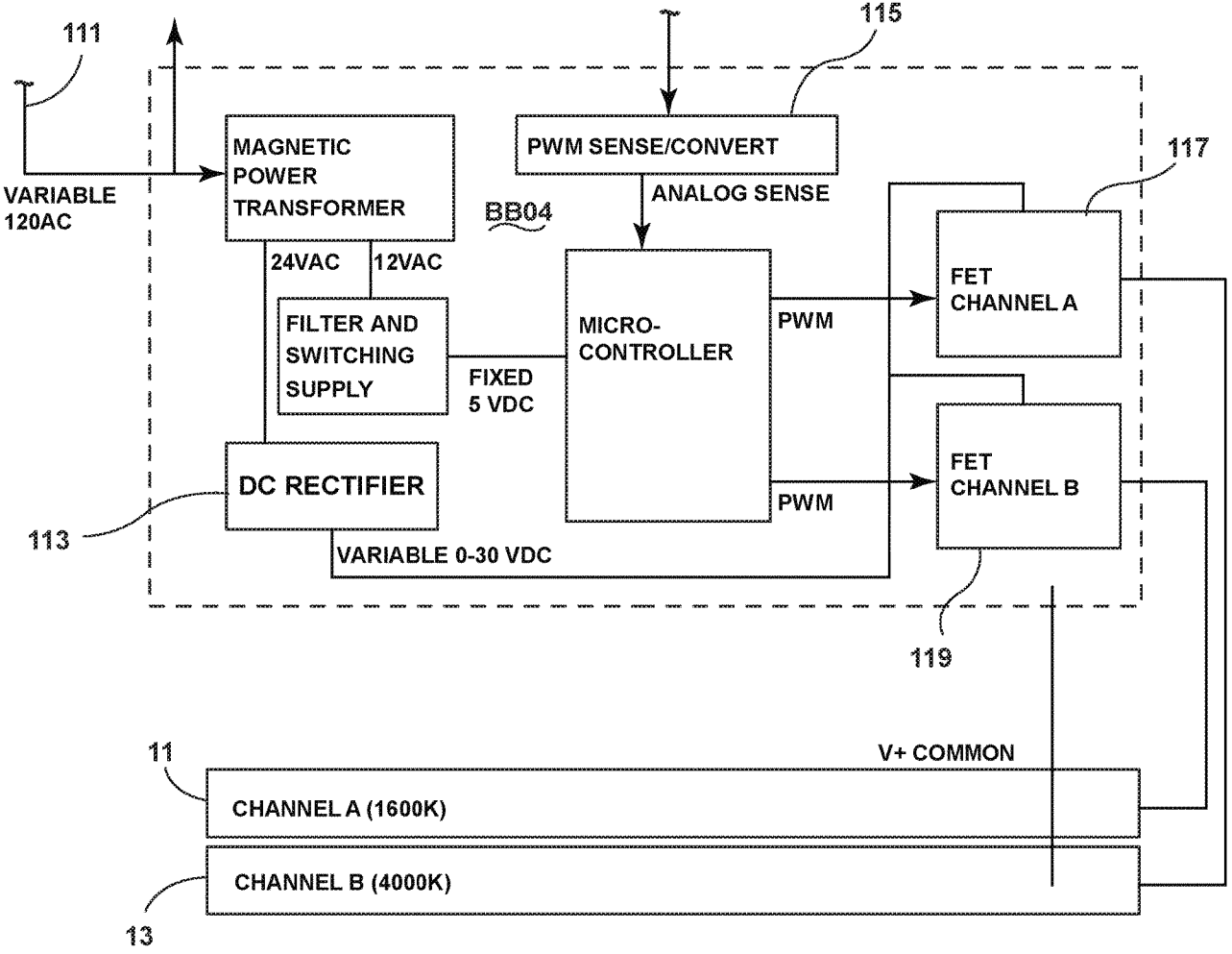
FIG. 3 is an enlarged view of a second portion of the block diagram of FIG. 1.

In the illustrative embodiment shown in the FIGS. 1-3, a standard Lutron MRF2 dimmer 107 is used to power and control the dimming. The dimmer 107 feeds a Lutron LTEAU1UKN-CV240 driver 109, which is used in tandem with circuitry BBO4 to control two strings of LEDs 11, 13, to create light of a variable mixed color and brightness. In operation of the illustrative embodiment, as the dimmer output level is reduced, the effective light color shifts from 4000 k to 1600 k, going from cool to warm.

The output of the wall dimmer 107 exclusively provides all power needed on signal line 111 to operate the system. The dimmer 107 outputs a phase controlled AC signal. That signal is split and is sent to the BB04 circuitry and to the Lutron driver 109. In the BB04 circuitry, this voltage is used to power a magnetic power transformer with two secondary voltages. One secondary voltage is 12 v AC, and a second is 24 v AC. The 12 v AC secondary voltage will vary based on the primary voltage at the power transformer, which varies as you dim.

The changing 12 v AC voltage is then fed to a filter and switching supply, which allows a wide range of workable voltage inputs. In the illustrative embodiment, the switching supply design handles these varying voltages, and translates that variable input into a fixed 5 v DC output, which is used to power a microcontroller, and will do so when dimmed even when below the range of LED illumination.

In the illustrative embodiment, the 24 v AC secondary winding is used to feed a second power supply section 113, at twice the value of the first, again with a standard bridge/cap combo to become a changing zero to 30 volt DC voltage. This voltage will eventually drive the LEDs, so it is more heavily filtered to eliminate visual flicker.

The BB04 circuitry also has an input for the return 110 from the output of the Lutron driver 109. This return 110 is a pulse width modulated (PWM) signal. While this PWM signal could be read directly by the microcontroller, in the illustrative embodiment, it is fed to a PWM Sense/Convert circuit where an analog filter is used to convert the PWM signal to a simple DC voltage, which is hardware buffered for isolation, and then read by a 10 bit ADC (analog to digital converter) to determine a voltage level representing the current dimmer setting. Employing the analog filter simplifies the microcontroller's firmware code.

The input values to the microcontroller are read multiple times per second, averaged for stability in the microcontroller code, and sent by the microcontroller as changing PWM signals to a pair of FETs 117, 119, each for a respective color channel, which, in one embodiment, may respectively use 1600 k and 4000 k LEDs. The FETs 117, 119 switch the onboard varying 30 v DC supply, adjusting the effective brightness levels of each color of LED string 11, 13, as the dimmer level output of the dimmer 107 changes. As the dimmer output value changes, the levels of each channel A, B, change to provide a balance of 4000 k and 1600 k light, with overall brightness changing at the same time In one embodiment, the microcontroller firmware may be written so that when the output of the dimmer 107 dips to the very bottom end, or to 0 volts, then the microcontroller will shut down. As the power is restored, the microcontroller boots back up and goes directly back into the program, measuring and setting the brightness levels. In one embodiment, a brownout level set in the microcontroller "fuses" to make this transition smoother in selected cases.

While the illustrative embodiment employs a microcontroller, those skilled in the art will appreciate that other forms of computing devices, such as a processor, microprocessor or discrete logic circuitry, could be employed to perform the tasks of the microcontroller in various other embodiments.

In another embodiment, a third channel of color may be added, with additional complexity in the fading algorithm. In such an embodiment, the brightness shift of each channel needs to account for the simultaneous voltage reduction, which is unique to this concept.

The just described system provides the capability to replicate the lighting characteristics of an incandescent filament lamp, whereby the CCT of the emitted light is reduced (becomes warmer on the Blackbody curve) as less power is applied to the bulb (i.e. as the bulb is dimmed), which may be desirable in certain applications such as restaurants or hospitality environments.

From the foregoing, those skilled in the art will appreciate that various adaptations and modifications of the just described illustrative embodiments can be configured without departing from the scope and spirit of the invention. Therefore, it is to be understood that, within the scope of the appended claims, the invention may be practiced other than as specifically described herein.

What is claimed is:

1. An LED light generator comprising:

a first LED channel comprising one or more LEDs of a first color temperature and connected to a first FET driver;

a second LED channel comprising one or more LEDs of a second color temperature and connected to a second FET driver;

a dimmer supplying an AC output signal;

an LED driver receiving the AC output signal as an input signal and providing a first pulse width modulated output signal;

a microcontroller configured to employ an input signal representing a present setting of the dimmer, the input signal comprising (a) the first pulse width modulated signal or (b) a signal derived from the first pulse width modulated signal to generate and supply a second pulse width modulated signal to said first FET driver and a third pulse width modulated signal to said second FET driver;

a transformer supplied with said AC output signal for generating a first AC output of a first voltage level and a second AC output of a second voltage level;

a first circuit receiving the first voltage level and supplying a fixed DC voltage to said microcontroller;

a second circuit receiving the second voltage level and supplying a variable DC voltage to said first FET driver and to said second FET driver;

wherein all power required to operate the LED light generator is supplied by the dimmer; and wherein the microcontroller is configured to respond to the dimming level represented by the input signal to generate second and third pulse width modulated signals which result in a combined light output from the first and second LED channels of a selected color and brightness.

2. The LED light generator of claim 1 wherein the microcontroller is configured to cause the combined light output to shift color from 4000 k to 1600 k as the output level of the dimmer is reduced.

3. The LED light generator of claim 1 wherein PWM sense/convert circuitry is configured to convert the first pulse width modulated signal to a DC voltage which is then A to D converted to generate said input signal to the microcontroller.

4. The LED light generator of claim 2 wherein PWM sense/convert circuitry is configured to convert the first pulse width modulated signal to a DC voltage which is then A to D converted to generate said input signal to the microcontroller.

5. The LED light generator of claim 1 wherein the first voltage level is 12V AC and wherein the second voltage level is 24 V AC.

6. The LED light generator of claim 3 wherein the PWM sense/convert circuitry comprises an analog to digital converter.

7. The LED light generator of claim 1 wherein the first and second FET drivers are configured to switch the variable DC voltage so as to adjust the brightness levels of each of the first and second LED channels as the output level of the LED dimmer changes.

8. A method comprising:

constructing a first LED channel comprising one or more LEDs of a first color temperature and connecting the first LED channel to a first FET driver;

constructing a second LED channel comprising one or more LEDs of a second color temperature and connecting the second LED channel to a second FET driver;

connecting an output of a wall dimmer to a driver circuit and to a power transformer, the driver circuit having an output; and configuring a microcontroller to employ an input signal representing a present setting of the wall dimmer and comprising (a) the first pulse width modulated signal or (b) a signal derived from the first pulse width modulated signal to generate and supply a second pulse width modulated signal to said first FET driver and a third pulse width modulated signal to said second FET driver;

configuring the power transformer to generate a first AC output of a first voltage level and a second AC output of a second voltage level;

configuring a first circuit to receive the first voltage level and to supply a fixed DC voltage to said microcontroller; and configuring a second circuit to receive the second voltage level and to supply a variable DC voltage to said first FET driver and to said second FET driver.

9. The method of claim 8 further comprising configuring the microcontroller to respond to the dimming level represented by the input signal to generate second and third pulse width modulated signals which result in a combined light output from the first and second LED channels of a selected color and brightness.

10. The method of claim 9 wherein the microcontroller is configured to cause the combined light output of the first and second LED channels to shift color from 4000 k to 1600 k as the output level of the wall dimmer is reduced.

11. The method of claim 8 further comprising configuring PWM sense/convert circuitry to convert the first pulse width modulated signal to a DC voltage and then A to D converting the DC voltage to generate said input signal to the microcontroller.

12. The method of claim 9 further comprising configuring PWM sense/convert circuitry to convert the first pulse width modulated signal to a DC voltage and then A to D converting the DC voltage to generate said input signal to the microcontroller.

13. The method of claim 8 wherein the first voltage level is 12V AC and wherein the second voltage level is 24 V AC.

14. The method of claim 8 further comprising configuring the first and second FET drivers to switch the variable DC voltage so as to adjust the brightness levels of each of the first and second LED channels as the output level of the wall dimmer changes.

15. The method of claim 9 further comprising configuring the first and second FET drivers to switch the variable DC voltage so as to adjust the brightness levels of each of the first and second LED channels as the output level of the wall dimmer changes.

16. An LED light generator comprising:

a first LED channel comprising one or more LEDs of a first color temperature and connected to a first driver circuit;

a second LED channel comprising one or more LEDs of a second color temperature and connected to a second driver circuit;

a dimmer supplying an AC output signal;

an LED driver receiving the AC output signal as an input signal and providing a first pulse width modulated output signal;

a microcontroller configured to employ an input signal representing a present setting of the dimmer, the input signal comprising (a) the first pulse width modulated signal or (b) a signal derived from the first pulse width modulated signal to generate and supply a second pulse width modulated signal to said first driver circuit and a third pulse width modulated signal to said second driver circuit;

a transformer supplied with said AC output signal for generating a first AC output of a first voltage level and a second AC output of a second voltage level;

a first circuit receiving the first voltage level and supplying a fixed DC voltage to said microcontroller; and a second circuit receiving the second voltage and supplying a variable DC voltage to said first and second driver circuits;

wherein all power required to operate the LED light generator is supplied by the dimmer.

17. The LED light generator of claim 16 wherein the microcontroller is further configured to respond to the dimming level represented by the input signal to generate second and third pulse width modulated signals which result in a combined light output from the first and second LED channels of a selected color and brightness.

* * * * *